US010926332B2

(12) United States Patent
Yun et al.

(10) Patent No.: US 10,926,332 B2
(45) Date of Patent: Feb. 23, 2021

(54) METHOD OF MANUFACTURING IRON POWDER AND IRON POWDER MANUFACTURED THEREBY

(71) Applicants: Hyundai Motor Company, Seoul (KR); Kia Motors Corporation, Seoul (KR)

(72) Inventors: Joon Chul Yun, Incheon (KR); Hyun Gon Lyu, Hwaseong-si (KR); Hyun Kyu Choi, Hwaseong-si (KR); Ji Min Yu, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 376 days.

(21) Appl. No.: 15/813,986

(22) Filed: Nov. 15, 2017

(65) Prior Publication Data

US 2018/0290213 A1 Oct. 11, 2018

(30) Foreign Application Priority Data

Apr. 10, 2017 (KR) ..... 10-2017-0046149

(51) Int. Cl.
*B22F 9/08* (2006.01)
*C22C 38/18* (2006.01)
(Continued)

(52) U.S. Cl.
CPC ..... *B22F 9/082* (2013.01); *C22C 38/004* (2013.01); *C22C 38/02* (2013.01); *C22C 38/04* (2013.01);
(Continued)

(58) Field of Classification Search
None
See application file for complete search history.

(56) References Cited

U.S. PATENT DOCUMENTS 4,080,126 A * 3/1978 Clark ..... B22F 9/082 425/7
6,342,087 B1 * 1/2002 Arvidsson ..... C22C 33/0285 75/255

FOREIGN PATENT DOCUMENTS

JP 6-93308 A 4/1994
JP 06-306403 A * 11/1994
(Continued)

OTHER PUBLICATIONS

English translation of JP 06-306403 (originally published Nov. 1994) from J-Plat Pat.*
(Continued)

*Primary Examiner* — George Wyszomierski
(74) *Attorney, Agent, or Firm* — Morgan, Lewis & Bockius LLP

(57) ABSTRACT

A method of manufacturing iron powder configured for improving a recovery rate of chromium using ingot including chromium in a content suitably higher than a target content at the time of manufacturing iron powder including chromium, may include preparing ingot further including chromium (Cr) so that a content of chromium (Cr) in the ingot is 1 to 30% higher than a target content of chromium (Cr) in finally produced iron powder; dissolving the ingot to prepare molten steel; forming iron powder by performing water atomization on the molten steel; and adjusting a content of carbon (C) in the iron powder by performing reduction treatment on the iron powder.

4 Claims, 4 Drawing Sheets

(51) Int. Cl.

| | |
|---|---|
| ***C22C 38/04*** | (2006.01) |
| ***C22C 38/00*** | (2006.01) |
| ***C22C 38/02*** | (2006.01) |
| *B22F 1/00* | (2006.01) |
| *C22C 33/02* | (2006.01) |

(52) U.S. Cl.

CPC ..... *C22C 38/18* (2013.01); *B22F 1/0007* (2013.01); *B22F 2009/0828* (2013.01); *B22F 2009/0848* (2013.01); *B22F 2301/35* (2013.01); *B22F 2998/10* (2013.01); *B22F 2999/00* (2013.01); *C22C 33/0257* (2013.01)

(56) References Cited

FOREIGN PATENT DOCUMENTS

| | | | |
|---|---|---|---|
| KR | 10-1997-0002097 | B1 | 2/1997 |
| KR | 10-2001-0049187 | A | 6/2001 |
| KR | 10-0570551 | | 4/2006 |
| KR | 10-1334156 | B1 | 11/2013 |
| KR | 10-2016-0002089 | A | 1/2016 |
| WO | WO 2017/051541 | A1 * | 3/2017 |

OTHER PUBLICATIONS

English translation of WO 2017/051541 (originally published Mar. 2017) from Espacenet.*

* cited by examiner

METHOD OF MANUFACTURING IRON POWDER AND IRON POWDER MANUFACTURED THEREBY

CROSS REFERENCE TO RELATED APPLICATION

The present application claims priority to Korean Patent Application No. 10-2017-0046149, filed Apr. 10, 2017, the entire contents of which is incorporated herein for all purposes by this reference.

BACKGROUND OF THE INVENTION

Field of the Invention

The present invention relates to a method of manufacturing iron powder and iron powder manufactured thereby, and more particularly, a method of manufacturing iron powder capable of improving a recovery rate of chromium using ingot including chromium in a content suitably higher than a target content at the time of manufacturing iron powder including chromium, and iron powder manufactured thereby.

Description of Related Art

Generally, iron powder is manufactured using a water atomization device, or the like, by mixing and dissolving scrap irons and molten iron produced in an iron making process in a steel-making furnace to prepare molten steel adjusted to have the desired contents, and then supplying the molten steel to a tundish. The present iron powder has been used for various uses, for example, a powder metallurgy material for manufacturing automobile parts, or the like, various additives, and the like.

Among the automobile parts, iron powder including Cr is manufactured by a general powder manufacturing process described above due to economical reasons. However, since a Cr ingredient contained in final powder has strong affinity to oxygen, generally, at the time of dissolving Cr in an air atmosphere, a Cr based oxide such as $Cr_2O_3$ is formed, such that it may be difficult to control a content of Cr in a final product.

Therefore, at the time of producing the iron powder including Cr, molten steel is prepared using an electric furnace or induction furnace. In the case of performing a dissolution process using the electric furnace, a process time for satisfying an ingredient content in a laddle furnace may be increased, and in the case of performing an induction process using the induction furnace, Cr contained in the molten steel may be continuously oxidized due to air introduced from the outside to form a composite oxide by an Fe—Cr—O reaction, and the present composite oxide may be changed into dross or slag to float on a surface of the molten steel or in the molten steel, and when the molten steel is supplied to the tundish for a water atomization process, which is a subsequent process, as the present composite oxide is introduced into a nozzle of the tundish to cause a clogging phenomenon of the nozzle, or build-up (growth) of the molten steel due to the clogging phenomenon, such that there may be a difficulty in perform the water atomization process.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a method of manufacturing iron powder configured for improving a recovery rate of chromium (Cr) using ingot including chromium in a content suitably higher than a target content at the time of manufacturing iron powder including chromium, and iron powder manufactured.

Various aspects of the present invention are directed to providing a method of manufacturing iron powder configured for preventing a clogging phenomenon of a nozzle of a tundish, or build-up (growth) of molten steel, using ingot including chromium in a content suitably higher than a target content at the time of manufacturing iron powder including chromium, and iron powder manufactured thereby.

According to an exemplary embodiment in the present invention, there is provided a method of manufacturing iron powder including chromium (Cr), the method including; preparing ingot further including chromium (Cr) so that a content of chromium (Cr) in the ingot is 1 to 30% higher than a target content of chromium (Cr) in finally produced iron powder (S1-1); dissolving the ingot to prepare molten steel (S1-2); forming iron powder by performing water atomization on the molten steel (S2); and adjusting a content of carbon (C) in the iron powder by performing reduction treatment on the iron powder (S3).

In the preparing of the ingot (S1-1), the target content of chromium (Cr) in the iron powder may be preferably 1.3 to 3.3 wt %.

In the preparing of the ingot (S1-1), the ingot may preferably further include carbon (C), silicon (Si), and manganese (Mn).

In the preparing of the ingot (S1-1), the ingot may preferably further include carbon (C): 0.1 to 0.4 wt %, silicon (Si): 0.1 to 0.25 wt %, and manganese (Mn): 0.3 wt % or less.

In the preparing of the molten steel (S1-2), the ingot may be dissolved under an air atmosphere.

In the adjusting of the content of carbon (S3), the content of carbon (C) in the iron powder may be adjusted to be 0.01 wt % or less by performing hydrogen reduction heat treatment on the iron powder.

In the adjusting of the content of carbon (S3), hydrogen reduction heat treatment may be preferably performed at 900 to 1200° C.

According to another exemplary embodiment in the present invention, there is provided a method of manufacturing iron powder including chromium (Cr), the method including; preparing molten steel including carbon (C): 0.1 to 0.4 wt %, silicon (Si): 0.1 to 0.25 wt %, and manganese (Mn): 0.3 wt % or less, further including chromium at a content 1 to 30 wt % higher than a target content of chromium (Cr) in finally produced iron powder; and including unavoidable impurities and the balance being iron (Fe) (S1); forming iron powder by performing water atomization on the molten steel (S2); and adjusting a content of carbon (C) in the iron powder by performing reduction treatment on the iron powder (S3).

In the preparing of the molten steel (S1), the target content of chromium (Cr) in the iron powder may be preferably 1.3 to 3.3 wt %.

In the preparing of the molten steel (S1), the molten steel may be prepared by melting ingot of which ingredients are adjusted.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
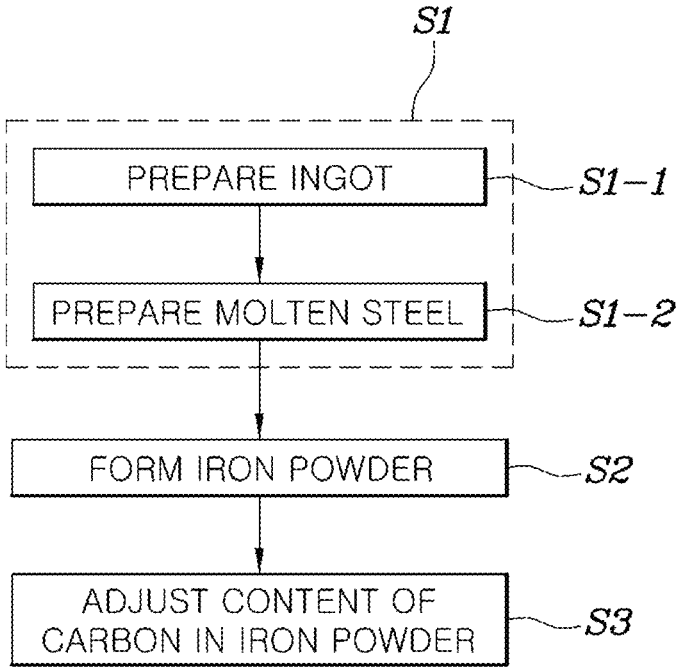
FIG. 1 is a flow chart illustrating a method of manufacturing iron powder according to an exemplary embodiment of the present invention.

It may be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, exemplary embodiments of the present invention will be described in detail with reference to the accompanying drawings. However, the present invention is not limited to the exemplary embodiments included herein but will be implemented in various forms. The present exemplary embodiments make disclosure of the present invention thorough and are provided so that those skilled in the art can easily understand the scope of the present invention.

First, iron powder manufactured according to an exemplary embodiment of the present invention is Fe—Cr based power, which is iron powder basically including chromium (Cr), but the technical spirit of the present invention may be applied to cases of manufacturing all iron powders having compositions including Cr.

FIG. 1 is a flow chart illustrating a method of manufacturing iron powder according to an exemplary embodiment of the present invention.

As illustrated in FIG. 1, the method of manufacturing iron powder according to the exemplary embodiment of the present invention roughly may include preparing molten steel (S1); forming iron powder by performing water atomization on the molten steel (S2); and adjusting a content of carbon (C) in the iron powder by performing reduction treatment on the iron powder.

The preparing of the molten steel (S1), which is a step of adjusting contents of ingredients forming the molten steel or changing a method of preparing the molten steel to improve a recovery rate of Cr and a recovery rate of the molten steel, may be roughly divided into preparing ingot (S1-1); and dissolving the ingot to prepare the molten steel (S1-2).

In the preparing of the ingot (S1-1), which is a step of preparing the ingot of which ingredients and contents are adjusted as a base material used for preparing the molten steel, the ingot is prepared so that a content of chromium (Cr) in the ingot is 1 to 30% higher than a target content of chromium (Cr) in finally produced iron powder. Here, the prepared ingot may be prepared in various shapes including a billet, a bloom, a slab, and the like.

The reason of using the ingot of which the ingredients are adjusted to prepare the molten steel instead of melting molten iron and scraps as in the relate art is that in the case of melting the molten iron and scraps as in the related art, ingredients in the molten iron are not alloyed but individually exist in a unstable state, respectively, such that the ingredients bind oxygen in the air to form oxides and thus, each of the ingredients is not recovered at the desired content in final iron powder. On the contrary, in the case of using the ingot of which the ingredients are adjusted as in the exemplary embodiment of the present invention, since the ingredients in the ingot are already alloyed and maintained in a stable state, a rate of the ingredient reacting oxygen in the air to form oxides is significantly decreased.

Meanwhile, the iron powder manufactured according to the exemplary embodiment in an exemplary embodiment of the present invention is a material used in sintering components for a vehicle including a connecting rod, a synchronizer hub, and the like, and the target content of Cr in the final iron powder is 1.3 to 3.3 wt %. More, tensile strength required in the sintering components for a vehicle including the connecting rod, the synchronizer hub, and the like, is about 900 MPa, and to maintain the present tensile strength, the target content of Cr is limited to 1.3 to 3.3 wt %. Further, in the iron powder as the material used in the sintering components for a vehicle including the connecting rod, the synchronizer hub, and the like, there is a need to manage inclusion to secure moldability. Therefore, the iron powder manufactured according to the exemplary embodiment of the present invention includes silicon (Si): 0.01 wt % or less, manganese (Mn): 0.1 wt % or less, and chromium (Cr): 1.3 to 3.3 wt %, and the balance being iron and unavoidable impurities.

Meanwhile, to satisfy 1.3 to 3.3 wt %, which is the target content of Cr in the final iron powder, the content of chromium (Cr) in the ingot is increased by 1 to 30% as compared to 1.3 to 3.3 wt % to become 1.313 to 4.29 wt %.

Further, to suppress oxidation of Cr in the ingot, the ingot further includes carbon (C), silicon (Si), and manganese (Mn), ingredients of which affinity to oxygen is higher than or similar to that of Cr in a temperature range in which the ingot is dissolved. Here, the ingot includes carbon (C): 0.1 to 0.4 wt %, silicon (Si): 0.1 to 0.25 wt %, and manganese (Mn): 0.3 wt % or less. Therefore, the ingot includes carbon (C): 0.1 to 0.4 wt %, silicon (Si): 0.1 to 0.25 wt %, and manganese (Mn): 0.3 wt % or less, further includes chromium at a content 1 to 30 wt % higher than 1.3 to 3.3 wt %, which the target content of chromium (Cr) in finally produced iron powder, and includes unavoidable impurities and the balance being iron (Fe).

The reason of adjusting the ingredients of the ingot, particularly, the reason of adjusting, the content of Cr to be 1 to 30% higher than the target content is to compensate an amount of Cr that is not recovered while forming a Cr based oxide including $Cr_2O_3$ at the time of dissolving the molten steel under an air atmosphere. However, in the case of preparing the molten steel using the molten iron and scraps as in the related art to produce the iron powder, a recovery rate of Cr is mostly 60% or less. However, in an exemplary embodiment of the present invention, the reason of using the ingot is that the recovery rate of Cr is improved by use of the ingot. Here, the reason of increasing the content of Cr in the ingot only by 1 to 30% is that the ingot further includes suitable contents of carbon (C), silicon (Si), and manganese (Mn) corresponding to the ingredients suppressing formation of the Cr-based oxide.

In addition, the contents of carbon (C), silicon (Si), and manganese (Mn) are decreased due to reactions with the air during dissolution, such that target contents of carbon (C), silicon (Si), and manganese (Mn) in the final iron powder may be maintained. Here, the contents of carbon (C), silicon (Si), and manganese (Mn) are decreased due to reactions with the air during dissolution. The reason is that oxides formed by reactions of each of the ingredients with oxygen float in and are separated from the molten steel due to a difference in specific gravity, such that the oxides are not contained in the final iron powder. Therefore, the contents of carbon (C), silicon (Si), and manganese (Mn) in the ingot are maintained to be slightly higher than contents of carbon (C), silicon (Si), and manganese (Mn) required in the final iron powder in consideration of the amounts of carbon (C), silicon (Si), and manganese (Mn) floating and separated from the molten steel in oxide forms.

However, when the contents of carbon (C), silicon (Si), and manganese (Mn) in the ingot exceed the contents described above, the contents of carbon (C), silicon (Si), and manganese (Mn) in the final iron powder exceed the desired contents, which deteriorate moldability of the iron powder. Therefore, the contents of carbon (C), silicon (Si), and manganese (Mn) in the ingot do not exceed the suggested contents.

Meanwhile, in the preparing of the molten steel (S1-2), which is a step of dissolving the ingot of which the ingredients are adjusted to prepare the molten steel, the prepared ingot may be melted at a dissolution temperature of 1450 to 1700° C. or so, preparing the molten steel.

Here, the ingot may be melted under an air-blocking atmosphere to suppress reaction between the molten steel and oxygen, but according to the exemplary embodiment of the present invention, since the ingot is used and carbon (C), silicon (Si), and manganese (Mn) are further contained in the ingot to prevent the recovery rate from being decreased due to the reaction of chromium with oxygen in the air, the ingot may be melted under the air atmosphere. For example, the molten steel may be prepared by melting the ingot in an induction furnace under the air atmosphere. Of course, since the ingot may be melted under both the air-blocking atmosphere and the air atmosphere, various devices including an electric furnace, a converter, and the like, configured for preparing the molten steel, as well as the induction furnace may be used.

When the molten steel is prepared as described above, the forming of the iron powder by performing water atomization (S2) may be performed.

In the forming of the iron powder (S2), the prepared molten steel is supplied to the tundish and water-atomized using a water atomization device, forming the iron powder.

In the iron powder produced through a water atomization process, a content of carbon (C) is maintained to be 0.1 to 0.25 wt %, a content of silicon (Si) is maintained to be 0.01 wt % or less, and a content of manganese (m) is maintained to be 0.1 wt % or less.

Since the content of carbon (C) in the iron powder produced through the water atomization process is excessively high, the adjusting of the content of carbon (C) in the iron powder by performing reduction treatment on the iron powder (S3) may be performed.

The adjusting of the content of carbon (S3) to is configured to secure moldability of the iron powder by adjusting the content of carbon (C) in the iron powder to be 0.01 wt % or less through hydrogen reduction heat treatment. Here, the hydrogen reduction heat treatment is performed at 900 to 1200° C.

Hereinafter, the present invention will be described through Comparative Examples and Examples.

First, the reason of preparing the molten steel using the ingot in an exemplary embodiment of the present invention will be described through comparison of Comparative Examples in which molten iron and scrap were used as in the related art and Examples in which ingot of which ingredients were adjusted as a method of preparing molten steel.

To maintain a content of chromium (Cr) in final iron powder to be 1.35 to 1.65 wt %, a target content of chromium (Cr) in final iron powder was set to 1.5 wt %, and thus, molten steels in which contents of chromium (Cr), carbon (C), silicon (Si), and manganese (Mn) were adjusted as illustrated in the following Table 1 were melted at 1650 and water-atomized in Comparative Examples and Examples, respectively. As such, a recovery rate of the molten steel powdered through water atomization was measured, and the result was illustrated in FIG. 2.

TABLE 1

| Classification | Content (wt %) of Cr in Final Iron Powder | Target Content (wt %) of Cr | Content (wt %) of Ingredient in Molten Steel C | Si | Mn | Cr | Fe | Form |
|---|---|---|---|---|---|---|---|---|
| Comparative Example 1 | 1.35~1.65 | 1.5 | — | — | — | 1.5 | Balance | Molten Iron + Scrap |
| Comparative Example 2 | | | 0.25 | 0.2 | 0.2 | 1.6 | Balance | Molten Iron + Scrap |
| Comparative Example 3 | | | 0.25 | 0.2 | 0.2 | 1.8 | Balance | Molten Iron + Scrap |
| Example 1 | | | — | — | — | 1.6 | Balance | Ingot |
| Example 2 | | | 0.25 | 0.2 | 0.2 | 1.7 | Balance | Ingot |
| Example 3 | | | 0.25 | 0.2 | 0.2 | 1.8 | Balance | Ingot |

Figure 2:
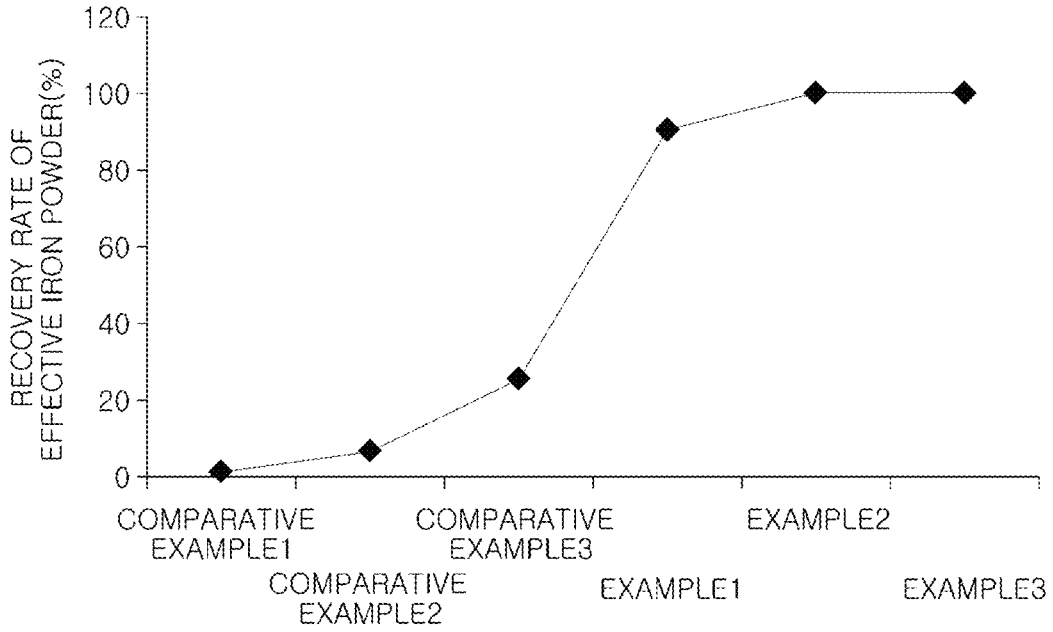
FIG. 2 is a graph illustrating recovery rates of molten steels in various Comparative Examples and Examples.

As illustrated in FIG. 2, it may be confirmed that in Comparative Examples 1 to 3 in which the molten steel was prepared without using ingot, the recovery rate of the powdered molten steel, that is, a recovery rate of effective iron powder was at most 25% or so, but in Examples 1 to 3 in which the molten steel was prepared using the ingot, the recovery rate of the effective iron powder was 100% or so.

It may be confirmed that in Comparative Example 1 in which carbon (C), silicon (Si), and manganese (Mn) serving to suppress chromium (Cr) from reacting with oxygen were not contained, but only chromium was contained at the target content, the recovery rate of the effective iron powder was almost zero.

Further, in the cases in which contents of carbon (C), silicon (Si), and manganese (Mn) satisfied the contents required in the exemplary embodiment of the present invention but the ingot was not used as in Comparative Examples 2 and 3, the recovery rate of the effective iron powder did not exceed at most 25% or so.

On the contrary, it may be confirmed that in Example 1 in which even though carbon (C), silicon (Si), and manganese (Mn) were not contained, but the ingot satisfying the content of chromium (Cr) was used, the recovery rate of the effective iron powder was about 90% or so.

Further, it may be confirmed that in the cases in which contents of carbon (C), silicon (Si), and manganese (Mn) satisfied the contents required in the exemplary embodiment of the present invention and the ingot was used as in Examples 2 and 3, the recovery rate of the effective iron powder was about 100% or so.

Figure 3:
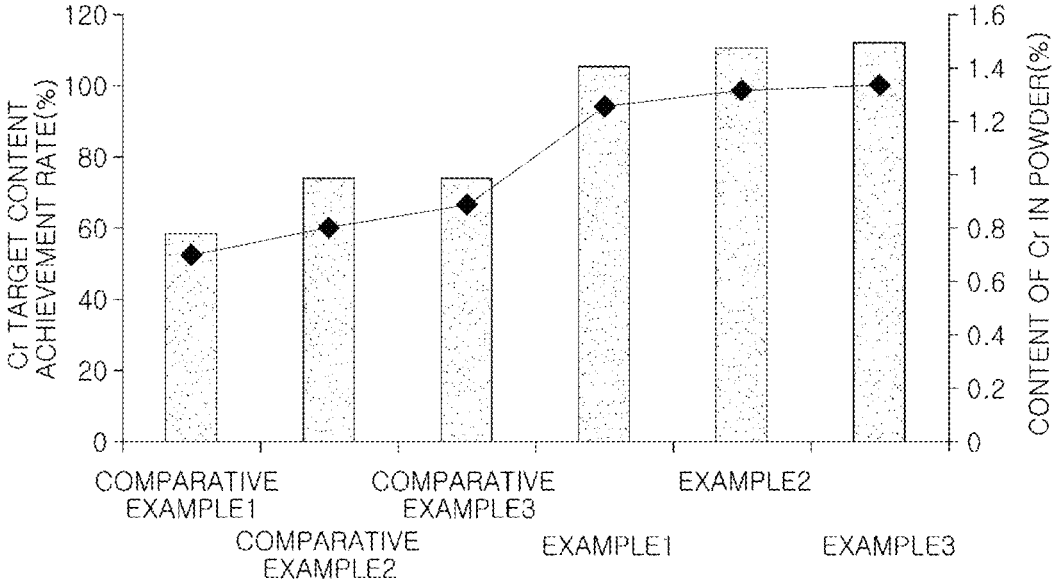
FIG. 3 is a graph illustrating recovery rates and contents of chromium (Cr) in final iron powders in various Comparative Examples and Examples.

Next, Cr target content achievement rates of the iron powder produced in Comparative Examples and Examples, and contents of Cr ingredients in the iron powder were measured, and the results were illustrated in FIG. 3.

As illustrated in FIG. 3, it may be confirmed that in Comparative Examples 1 to 3 in which the molten steel was prepared without using ingot, the Cr target content achievement rate of iron powder was about at 50 to 70% or so, but in Examples 1 to 3 in which the molten steel was prepared using the ingot, the Cr target content achievement rate of the iron powder was about 100% or so.

It may be confirmed that in Comparative Example 1 in which carbon (C), silicon (Si), and manganese (Mn) serving to suppress chromium (Cr) from reacting with oxygen were not contained, but only chromium was contained at the target content, the Cr target content achievement rate of the iron powder was about 50% or so.

Further, in the cases in which contents of carbon (C), silicon (Si), and manganese (Mn) satisfied the contents required in the exemplary embodiment of the present invention but the ingot was not used as in Comparative Examples 2 and 3, the Cr target content achievement rate of the iron powder did not exceed at most 70% or so.

On the contrary, it may be confirmed that in Example 1 in which even though carbon (C), silicon (Si), and manganese (Mn) were not contained, but the ingot satisfying the content of chromium (Cr) was used, the Cr target content achievement rate of the iron powder was about 90% or so.

Further, it may be confirmed that in the cases in which contents of carbon (C), silicon (Si), and manganese (Mn) satisfied the contents required in the exemplary embodiment of the present invention and the ingot was used as in Examples 2 and 3, the Cr target content achievement rate of the iron powder was about 100% or so.

Therefore, it may be confirmed that in Comparative Examples, the content of chromium (Cr) in the iron powder did not exceed 1.35 to 1.65 wt %, which was the target content, but in Examples, the content of chromium (Cr) in the iron powder satisfied 1.35 to 1.65 wt %, which was the target content.

Figure 4A:
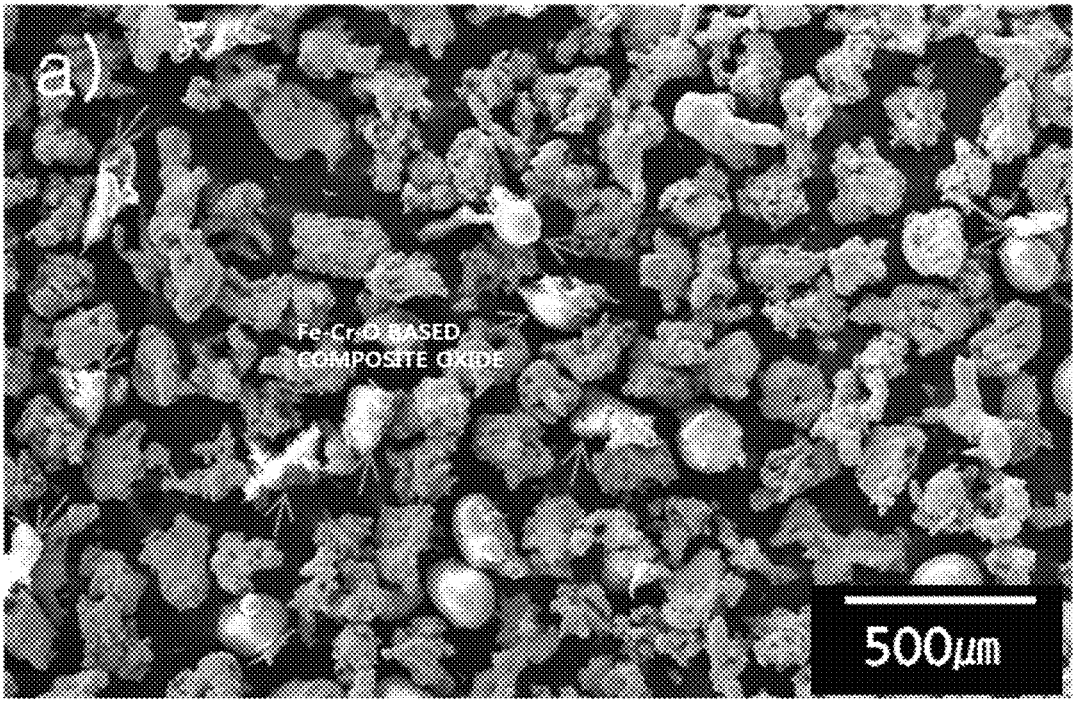
FIG. 4A and FIG. 4B are scanning electron microscope (SEM) photograph of iron powders in Comparative Example and Example.
Figure 4B:
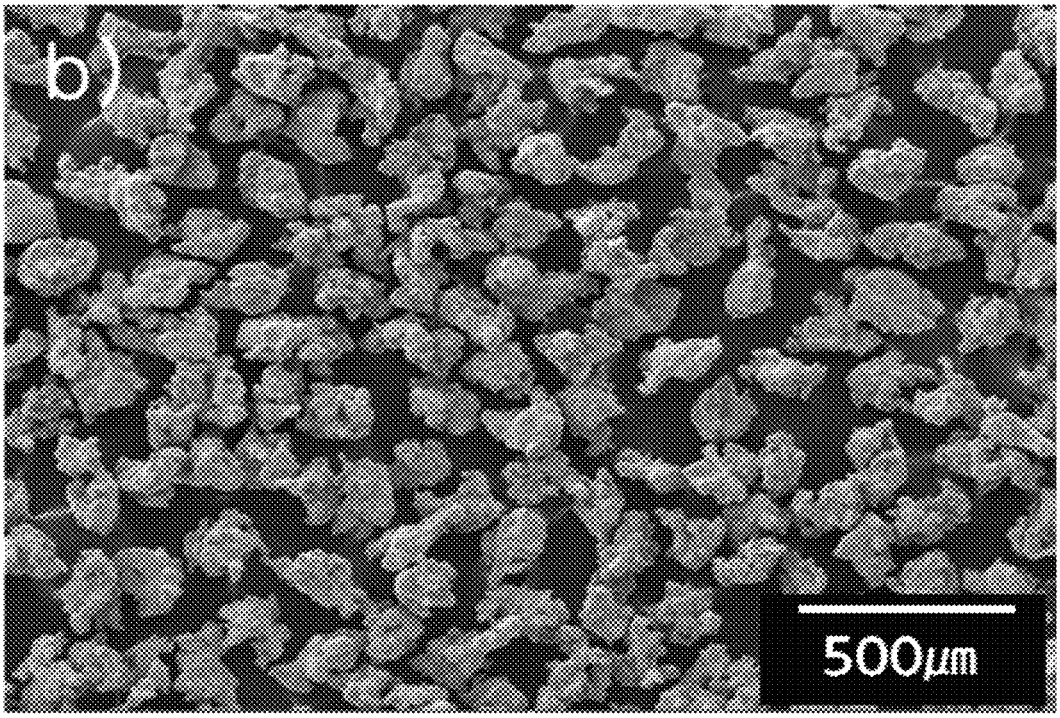

Next, scanning electron microscope (SEM) photographs of the iron powder produced in Comparative Example 3 and Example 3 were illustrated in FIG. 4A and FIG. 4B.

FIG. 4A is the SEM photograph of the iron powder in Comparative Example 3, and FIG. 4B is the SEM photograph of the iron powder in Example 3.

As illustrated in FIG. 4A, it may be confirmed that in the case in which ingot was not used, there was a large amount of foreign material powders formed while an Fe—Cr—O based composite oxide (indicated by an arrow in FIG. 4A) formed in the molten steel was powdered. On the contrary, as illustrated in FIG. 4B, it may be confirmed that in the case in which the ingot was used, there was almost no Fe—Cr—O based composite oxide in the iron powder.

According to the exemplary embodiment of the present invention, as the molten steel is prepared by use of the ingot of which the ingredients and contents are adjusted, it is possible to suppress chromium (Cr) contained in the molten steel from reacting with oxygen in the air during the preparing the molten steel to form the chromium oxide, making it possible to improve the recovery rates of chromium (Cr) and the molten steel at the time of producing the iron powder.

Further, at the time of preparing the molten steel, the molten steel includes carbon (C), silicon (Si), and manganese (Mn), which suppress the reaction between chromium and oxygen, in suitable contents in addition to chromium, such that it is possible to suppress chromium (Cr) contained in the molten steel from reacting with oxygen in the air during the preparing the molten steel to form the chromium oxide, making it possible to improve the recovery rates of chromium (Cr) and the molten steel at the time of producing the iron powder.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A method of manufacturing an iron-based powder including a target of 1.3 to 3.3 wt % chromium (Cr), the method comprising:

preparing an ingot including carbon (C): 0.1 to 0.4 wt %, silicon (Si): 0.1 to 0.25 wt %, and manganese (Mn): 0.3 wt % or less, further including chromium at a content 1 to 30% higher in relative terms to said target content; and including unavoidable impurities and a balance being iron (Fe);

dissolving the ingot to prepare molten steel and, forming the iron-based powder by performing water atomization on the molten steel;

adjusting a content of carbon (C) in the iron-based powder by performing reduction treatment on the iron-based powder.

2. The method of claim 1, wherein in the preparing of the molten steel, the ingot is dissolved under an air atmosphere.

3. The method of claim 1, wherein in the adjusting of the content of carbon, the content of carbon (C) in the iron-based powder is adjusted to be 0.01 wt % or less by performing hydrogen reduction heat treatment on the iron-based powder.

4. The method of claim 3, wherein in the adjusting of the content of carbon, the hydrogen reduction heat treatment is performed at 900 to 1200° C.

* * * * *